United States Patent [19]

Kawai et al.

[11] Patent Number: 4,585,047

[45] Date of Patent: Apr. 29, 1986

[54] APPARATUS FOR COOLING MOLTEN METAL IN A MOLD

[75] Inventors: Hiroshi Kawai; Yukio Ootsuka, both of Toyota, Japan

[73] Assignee: Toyota Jidosha Kabushiki Kaisha, Aichi, Japan

[21] Appl. No.: 575,798

[22] Filed: Feb. 1, 1984

[51] Int. Cl.[4] ..... B22D 27/04

[52] U.S. Cl. ..... 164/126; 164/128; 164/348

[58] Field of Search ..... 164/122, 122.1, 122.2, 164/126, 128, 348

[56] References Cited

U.S. PATENT DOCUMENTS

| | | | |
|---|---|---|---|
| 305,777 | 9/1884 | Babbitt | 164/348 |
| 2,110,360 | 3/1938 | Fisher | 164/348 X |
| 2,316,180 | 4/1943 | Mueller | 164/348 X |

FOREIGN PATENT DOCUMENTS

| | | | |
|---|---|---|---|
| 51-41571 | 11/1976 | Japan . | |
| 54-13208 | 5/1979 | Japan . | |
| 0627913 | 10/1978 | U.S.S.R. | 164/348 |

*Primary Examiner*—Nicholas P. Godici
*Attorney, Agent, or Firm*—Parkhurst & Oliff

[57] ABSTRACT

An apparatus for cooling the molten metal in a mold in order to cause directional solidification. The apparatus includes a pipe extending into a mold cavity, which is defined by a space between mold pieces, with cooling fluid flowing therethrough.

13 Claims, 9 Drawing Figures

APPARATUS FOR COOLING MOLTEN METAL IN A MOLD

BACKGROUND OF THE INVENTION

The present invention relates to an apparatus for cooling molten metal in a mold, and more particularly to the apparatus which cools the molten metal in the mold through cooling means provided in a casting cavity.

It is known that it is preferable to expedite the solidification of the molten metal in the mold and perform directional solidification in order to manufacture a cavity-free aluminum alloy.

Heretofore, in gravity die casting and the low pressure die casting, molten metal was solidified in dies cooled by water or air. However, strict temperature control of the die is required so that potential supercooling of the die can be obviated. The temperature of the die is periodically varied with the manufacturing cycle. Therefore, a high level temperature control is needed. In order to attain this, a complicated die structure was needed and the manufacturing cost increased because a cooling system was installed within the die.

Moreover, the positions, forms and volumes of the molten metal riser were experimentally determined to create directional solidification to obviate problems associated with the occurrence of a shrinkage cavity or vug in the die casted piece. However, the positions, forms and volumes of the riser were restricted by the shape and form of the die. Therefore, it is often impossible to create directional solidification by only modifying the riser.

Another widely practiced technique is placing a coating of a refractory material on the metal die. The die is designed to control the solidification rate of the molten metal therein by selectively choosing the refractory composition and the coating thickness of the refractory lining. This technique has difficulties associated with accurately controlling the solidification rate of the molten metal because of the heat transfer mechanism which occurs between the molten metal, the refractory coating layer and the die.

SUMMARY OF THE INVENTION

The present invention was made in view of the foregoing background and to overcome the foregoing drawbacks. It is accordingly an object of this invention to provide an improved apparatus for expediting the solidification of molten metal in a mold while attaining improved directional solidification.

To attain the above object, the apparatus for cooling the molten metal in a mold according to the present invention includes a pair of molds and a cooling means for cooling the molten metal poured into the mold cavity, which is defined by a space occurring between the pair of molds. The cooling means is located in the mold cavity and directly cools the molten metal.

BRIEF DESCRIPTION OF THE DRAWINGS

The above object, features and advantages of the present invention will become more apparent from reading the following description of the preferred embodiments taken in conjunction with the accompanying drawings, wherein.

DETAILED DESCRIPTION OF THE PREFERRED EMBODIMENTS

The present invention is described in detail with reference to the accompanying drawings which illustrate different embodiments of the present invention.

Figure 1:
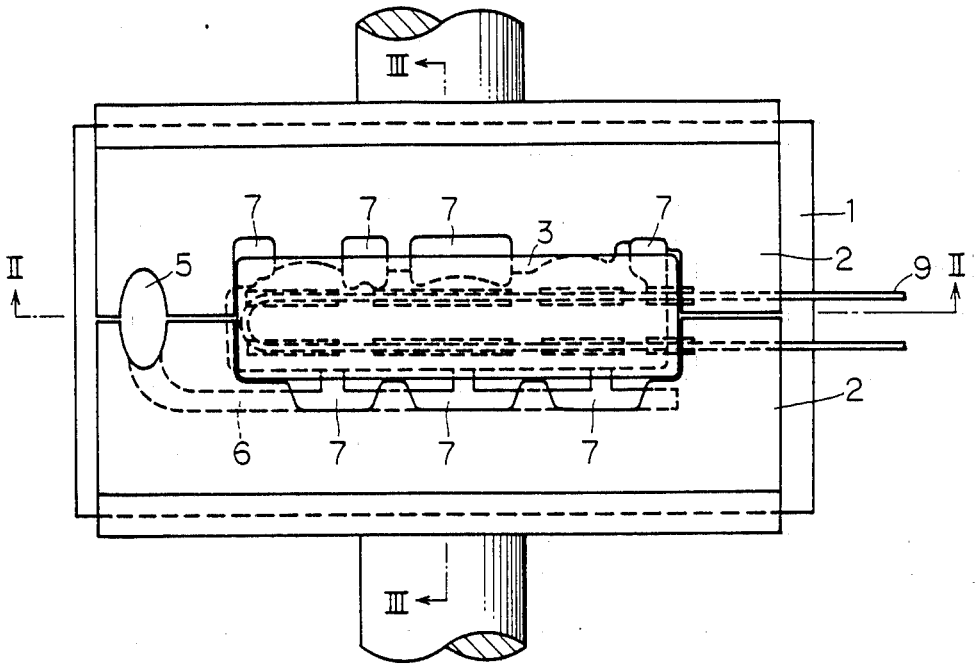
FIG. 1 is a plan view of an embodiment of the apparatus of the present invention.
Figure 2:
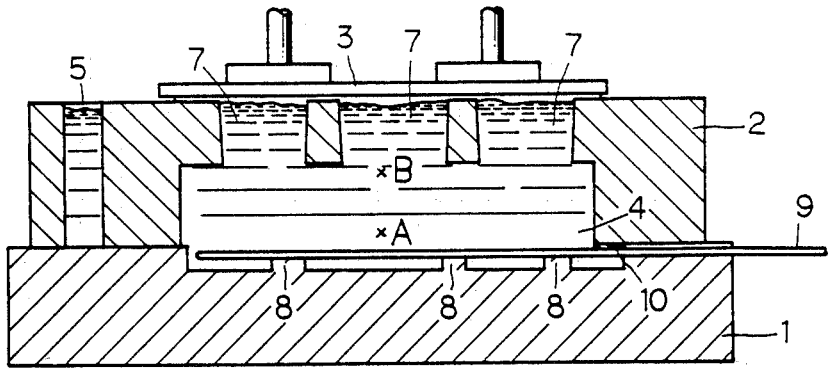
FIG. 2 is a longitudinal cross-sectional view taken along the line II—II of FIG. 1.
Figure 3:
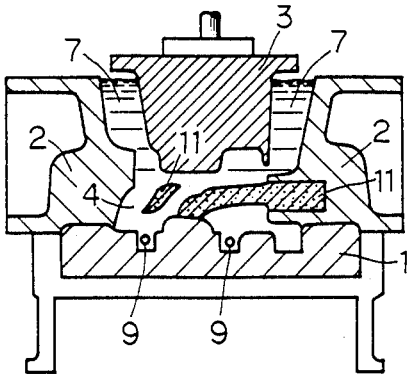
FIG. 3 is a transverse cross-sectional view taken along the line III—III of FIG. 1.

Referring now to the drawings wherein the same reference characters designate corresponding parts throughout the several views, the first embodiment of the present invention is illustrated in FIGS. 1 through 3. A casting mold has a drag 1, horizontal parts 2 mounted on the drag 1 and a cope 3 mounted on the horizontal parts 2. A mold cavity 4 is defined by the space between the cope 3, the horizontal parts 2 and the drag 1. The cope 3 is designed so that it can be vertically moved by suitable means such as shafts, and thereby close the opening defined by the periphery of the horizontal parts 2 with some amount of pressure exerted upon the parts 2. A sprue hole 5 is provided on the top portion of the horizontal parts 2 for receiving molten metal therein, and is connected with the mold cavity 4 by a runner 6. The upper part 7 of the molten metal in the mold cavity 4 functions as a riser. The horizontal parts 2 support at least one core 11 extending into the mold cavity 4. The drag 1 includes a plurality of projecting portions 8 which project into the mold cavity 4. A pipe 9 is inserted into the mold cavity 4. The pipe 9 is supported by the projecting portions 8 in the lower part of the mold cavity 4 and by the drag 1 at a position between the horizontal part 2 and the drag 1. The position between the horizontal part 2 and the drag 1 is sealed by a sealing member 10, such as clay. The pipe 9 has a U-shaped form, as shown in FIG. 1, and permits the flow of cooling fluid therein. Both ends of the pipe 9 extend outside the mold assembly, with the pipe connected to an apparatus for supplying cooling fluid, such as water, therethrough. The pipe 9 is designed to have a melting point higher than that of the molten metal in the cavity 4.

The aforementioned structure is assembled and functions as follows: The pipe 9 is laid on the projecting portions 8 of the drag 1. Then the sealing member 10 is attached around the pipe 9 at a position interposed between the horizontal part 2 and the drag 1. The cope 3 is pressed onto the opening defined between the horizontal parts 2 with some amount of the pressure. After this stage, the molten metal, such as an aluminum alloy, is poured into the sprue hole 5. The condition shown in FIG. 2 illustrates a completed pour with the pipe 9 shrouded in the molten metal. Cooling fluid then flows through the pipe 9 thereby cooling the molten metal around the pipe 9. Through this cooling operation, the solidification of the molten metal is remarkably expedited. Further, after preliminary solidification around the pipe 9, the solidification promptly propagates to positions distant from the pipe 9. This prompt directional solidification results in cavity-free products and shortening the manufacturing time for the cast products.

The positioning of the pipe 9 in the lower part of the mold cavity 4 results in directional solidification from the pipe 9 upwards toward the riser 7. This type of directional solidification is preferable from the standpoint of manufacturing high quality cast products.

After the molten metal is solidified, the excess portion of the solidified casting is cut away by a machining process and is therefore separate from the useable product. The pipe 9 can be repeatedly used after the excess portion is melted away from it.

Figure 4:
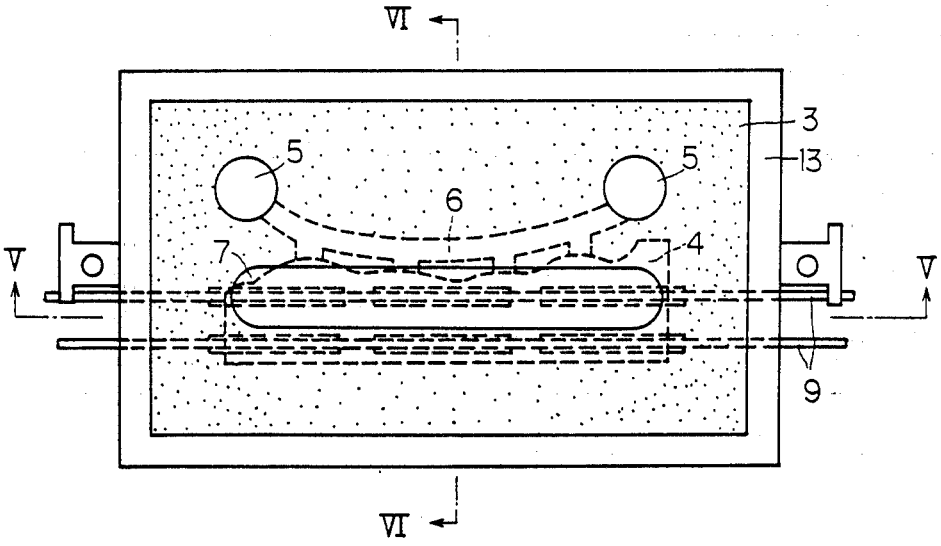
FIG. 4 is a plan view of another embodiment of the apparatus of the present invention.
Figure 5:
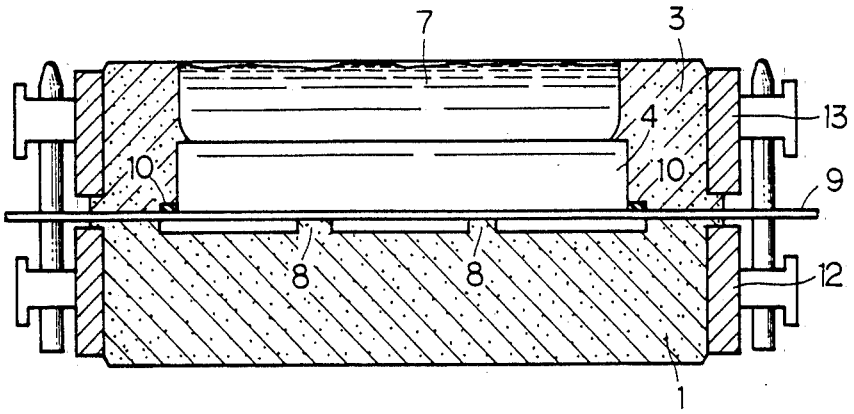
FIG. 5 is a longitudinal cross-sectional view taken along the line V—V of FIG. 4.
Figure 6:
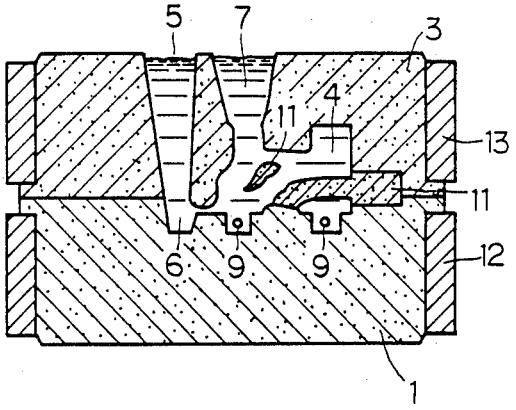
FIG. 6 is a transverse cross-sectional view taken along the line VI—VI of FIG. 4.

Referring next to FIGS. 4 through 6, there is illustrated a second embodiment of the present invention. In this embodiment, the mold cavity 4 is defined by the space between the drag 1, the cope 3 and the core 11. The pipes 9 are straight and extend outward through both longitudinal ends of the mold assembly, as shown in FIGS. 4 and 5. The pipes 9 are similarly positioned in the lower part of the mold cavity resulting in directional solidification from the pipe 9 upward toward the riser 7 upon a cooling fluid flowing therethrough. The drag 1 and the cope 3 are comprised of sand or a similar material, molds, and receive support from the metal flasks 12 and 13.

Figure 7:
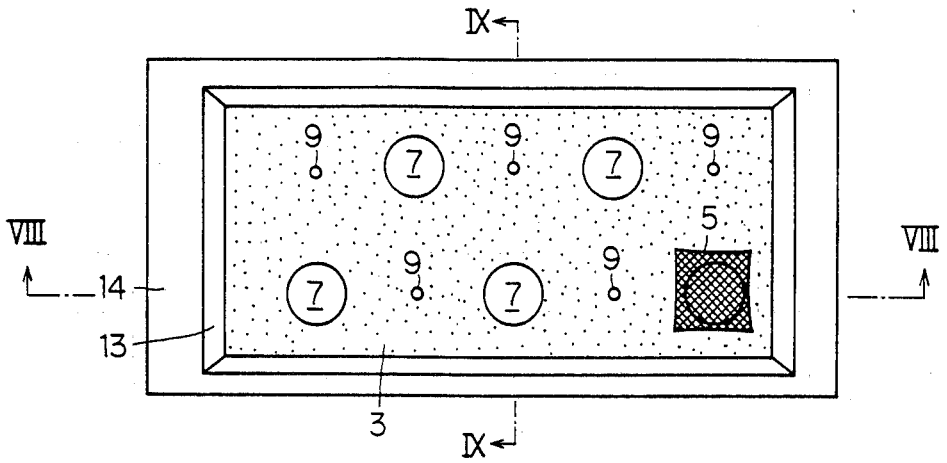
FIG. 7 is a plan view of another embodiment of the apparatus of the present invention.
Figure 8:
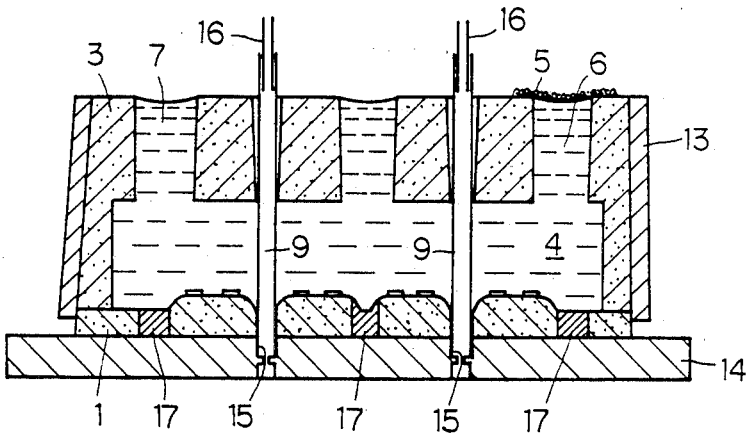
FIG. 8 is a longitudinal cross-sectional view taken along the line VIII—VIII of FIG. 7.
Figure 9:
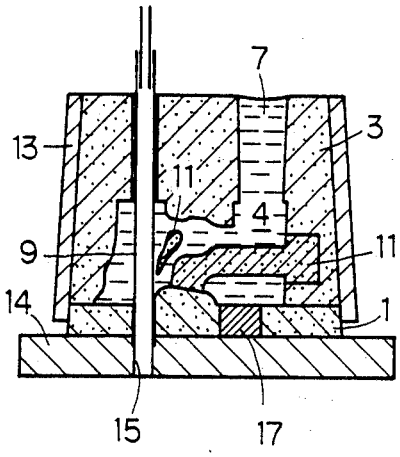
FIG. 9 is a transverse cross-sectional view taken along the line IX—IX of FIG. 7.

Referring to FIGS. 7 through 9, there is illustrated a third embodiment of the present invention. In this embodiment, a plurality of pipes 9 vertically penetrate the mold cavity 4 from the upper to lower part. In this embodiment, the pipes 9 remain within the cast metal piece as part of the desired end product. The upper ends of the pipes 9 have pipes 16 inserted therein, while the lower ends of the pipes 9 are inserted into holes 15 provided in a molding base 14, which supports the drag 1 thereon. The placement of the pipes 9 into the holes 15 assure that the pipes 9 are located in specific predetermined positions. The pipes 9 and the risers 7 are alternately positioned in the mold cavity 4, as shown in FIG. 7. In this embodiment, chillors 17 are located in the drag 1 to provide for better directional solidification.

In the process of manufacturing the cast product, cooling fluid, such as water, is supplied into the pipes 9. The fluid may flow through the pipes at any time, however, the sooner the cooling fluid is supplied into the pipes, the sooner the molten metal begins to solidify. The pipes 9 are provided in a spaced relationship within the mold cavity 4. The entire mold cavity 4 is remarkably promptly solidified upon the commencement of cooling fluid flow through the pipes 9. This prompt solidification results in improving the quality and the mechanical properties of the cast product.

Next, the experimental results according to the present invention are explained.

TABLE I

| Diameter of Pipes | Solidification Time Position A | Solidification Time Position B | Time for Accomplishing One Casting Cycle | Comparison Ratio of Volume of Riser | Porosity % Position A | Porosity % Position B | Tensile Strength kg/mm$^2$ |
|---|---|---|---|---|---|---|---|
| None | 1 min. 56 secs. | 3 mins. 10 secs. | 8 mins. | 1 | more than 1.08 | more than 1.08 | 21.5 |
| 8 mm | 1 min. 3 secs. | 1 min. 18 secs. | 5 mins. | 0.8 | 0.40 | 0.44 | 28.6 |
| 15 mm | 40 secs. | 45 secs. | 4 mins. | 0.5 | 0.09 | 0.12 | 30.8 |

The results shown in Table I are from the apparatus shown in FIGS. 1 through 3. The material used for casting is an aluminum alloy which includes the following ingredients listed by weight percents:

Cu: 3.0–4.5%, Si: 8.0–10.5%, Mg: 0.3–0.7%
Zn,Fe: equal to or smaller than 0.5%,
Mn: 0.3–0.7%, Ti: equal to or smaller than 0.2%
Al: the remainder (The above aluminum alloy is similar to that of AC-4B given in the Japanese Industrial Standard.)

In this experimentation, the conventional process (indicated by "NONE" in the "Diameter of Pipe" column in Table I) corresponded to the reference condition of no cooling fluid flowing through the pipe. Two different diameter sizes were used for the pipes 9 with the comparative results given in Table I. The smaller pipe had a diameter of 8 mm, the temperature of the water flowing through the pipe was 25° C. and the rate of water flowing through the pipe was 5 liters per minute. The larger pipe had a diameter of 15 mm, the temperature of the water flowing through the pipe was 25° C. and the rate of water flowing through the pipe was 30 liters per minute.

In Table I, the position "A" corresponds to the lower portion of the central cross-section of the mold cavity, as indicated in FIG. 2. The position "B" is that of the upper portion of the central cross-section of the mold cavity, as indicated in FIG. 2. The solidification time is herein defined as the time needed for completion of the eutectic solidification of Al-Si. The tensile strength corresponds to samples taken from the position "A" after a heat treatment known as T-6 (solution/water quench/aging) was performed. The "Comparison Ratio of Volume of Riser" is the ratio of the amount of the riser according to the present embodiment to the amount of riser of the conventional process.

TABLE II

| Diameter of Pipes | Solidification Time Position A | Solidification Time Position B | Comparison Ratio of Volume of Riser | Porosity % Position A | Porosity % Position B | Tensile Strength kg/mm$^2$ |
|---|---|---|---|---|---|---|
| None | 3 min. | 12 mins 7 secs. | 1 | more than 1.62 | more than 1.62 | 18.3 |
| 8 mm | 1 min. | 1 min. 35 secs. | 0.8 | 0.33 | 0.40 | 29.5 |

TABLE II-continued

| Diameter of Pipes | Solidification Time Position A | Solidification Time Position B | Comparison Ratio of Volume of Riser | Porosity % Position A | Porosity % Position B | Tensile Strength kg/mm² |
|---|---|---|---|---|---|---|
| 15 mm | 30 secs. | 42 secs. | 0.5 | 0.06 | 0.07 | 32.6 |

The results shown in Table II are from the apparatus shown in FIGS. 4 through 6. The material of the casting is the same material described in association with Table I. The conditions and the meanings of the terms in Table II are the same as those in Table I. The pipes may be provided at positions where the molten metal is required to be promptly solidified. When the pipes are closely located to the casting product, the cooling effect is great.

TABLE III

| Number of Pipes | Solidification Time Position A | Solidification Time Position B | Comparison Ratio of Volume of Riser | Porosity % Position A | Porosity % Position B | Tensile Strength kg/mm² |
|---|---|---|---|---|---|---|
| None | 3 mins. | 12 mins 7 secs. | 1 | more than 1.62 | more than 1.62 | 18.3 |
| 5 mm | 1 min. 5 secs. | 1 min. 30 secs. | 0.4 | 0.42 | 0.44 | 34.5 |
| 6 mm | 50 secs. | 1 min. 15 secs. | 0.3 | 0.38 | 0.40 | 35.7 |

The results shown in Table III are from the apparatus shown in FIGS. 7 through 9. The material used for casting is the same material described in association with Table I. The conditions and the meanings of the terms in Table III are the same as those in Table I.

While the present invention has been described in its preferred embodiments, it is to be understood that the invention is not limited thereto, and may be otherwise embodied within the scope of the following claims.

What is claimed is:

1. An apparatus for cooling molten metal for solidification into a cast product, said apparatus comprising:

a base member having a plurality of holes therethrough and located in said base in a predetermined arrangement, each of said plurality of holes in said base having a first diameter portion with a first diameter and a second diameter portion with a second diameter less than said first diameter;

a first mold mounted on the base member and having a plurality of apertures extending therethrough, said plurality of apertures corresponding in number and position to said plurality of holes in said base;

a second mold mounted on said first mold and defining a mold cavity therebetween for receiving molten metal, said second mold having a plurality of openings extending therethrough, said plurality of openings corresponding in number and position to said plurality of holes in said base, each of said plurality of openings and apertures being aligned with a corresponding one of said plurality of holes to form a plurality of aligned passages; and means for cooling molten metal in said mold cavity, said cooling means being a plurality of pipes extending through said molten metal in said mold cavity, each pipe having an outside diameter approximately equal to said first diameter of said holes, each pipe extending through a corresponding one of said plurality of aligned passages and through a first diameter portion of a corresponding hole, each pipe being supported in said base by said second diameter portion of said corresponding hole to position each of said pipes in said predetermined arrangement as said molten metal solidifies into said product;

wherein the cast product includes an excess portion and a finished portion, and the plurality of pipes are located in said predetermined arrangement in the excess portion of the cast product, the excess portion being separated subsequently from the finished portion of the cast product.

2. The apparatus of claim 1, wherein a core is located within said mold cavity, the core being supported by said second mold.

3. The apparatus of claim 1, wherein said first and second molds are formed of one of the group of sand and metal.

4. The apparatus of claim 1, further comprising means for circulating cooling fluid with each of said plurality of pipes.

5. The apparatus of claim 4, wherein the cooling fluid is water.

6. The apparatus of claim 1, wherein each of the plurality of pipes extends generally vertically into and through said mold cavity.

7. The apparatus of claim 1, wherein said second mold includes a plurality of risers.

8. The apparatus of claim 7, wherein said plurality of risers are alternately located in the mold cavity in relation to said plurality of pipes.

9. The apparatus of claim 1, wherein said plurality of pipes extend generally vertically through said mold cavity and are supported on said second diameter portions of said holes, said second diameter portion limiting the extent to which each of said plurality of pipes extends into said base.

10. A method for producing a cavity-free cast product from molten metal comprising the steps of:

mounting a second mold on a first mold to define a mold cavity therebetween;

inserting a pipe for cooling molten metal into and through said mold cavity;

pouring molten metal into said mold cavity and around said pipe;

supplying cooling fluid into the pipe to form a cavity-free material upon solidification of said molten metal;

removing the first and second molds from said cavity-free material, the cavity-free material having a first portion surrounding the pipe and a second portion; and separating the first portion from the second portion so that the second portion of the cavity-free material is incorporated in the cavity-free product.

11. The method of claim 10, wherein the step of inserting the pipe into the mold cavity includes positioning an opening in each of said first and second molds such that said openings are aligned in a predetermined position corresponding to the first portion of the cavity-free material, and inserting the pipe through the aligned openings of the first and second molds.

12. A method of producing a cavity-free cast product from a molten material comprising the steps of:

mounting a second mold on a first mold to define a mold cavity therebetween;

inserting a pipe for cooling molten metal into said mold cavity;

supplying cooling fluid into the pipe to form a cavity-free material upon solidification of said molten metal;

pouring molten metal into said mold cavity and around said pipe;

removing the first and second molds from said cavity-free material, the cavity-free material having a first portion surrounding the pipe and a second portion; and separating the first portion from the second portion so that the second portion of the cavity-free material is incorporated in the cavity-free product.

13. The method of claim 12, wherein the step of inserting the pipe into the mold cavity includes positioning an opening in each of said first and second molds such that said openings are aligned in a predetermined position corresponding to the first portion of the cavity-free material, and inserting said pipe through the aligned openings of the first and second molds.

* * * * *